US005156222A

United States Patent [19]

Jürgens et al.

[11] Patent Number: 5,156,222

[45] Date of Patent: Oct. 20, 1992

[54] DIRECTIONAL DRILLING TOOL APPARATUS AND METHOD

[75] Inventors: Rainer Jürgens, Celle; Rudolf Röper, Dortmund; Joachim Oppelt, Hanover; Dietmar Krehl, Lachendorf; Dagobert Feld, Hanover, all of Fed. Rep. of Germany

[73] Assignee: Baker Hughes Incorporated, Houston, Tex.

[21] Appl. No.: 612,909

[22] Filed: Nov. 13, 1990

[30] Foreign Application Priority Data

Nov. 30, 1989 [DE] Fed. Rep. of Germany ..... 3939538

[51] Int. Cl.[5] ..... E21B 4/14; E21B 7/06

[52] U.S. Cl. ..... 175/26; 175/45; 175/61

[58] Field of Search ..... 175/24, 25, 26, 27, 175/45, 61, 76, 296

[56] References Cited

U.S. PATENT DOCUMENTS

| | | | |
|---|---|---|---|
| 3,062,303 | 11/1962 | Schultz | 175/61 |
| 3,706,348 | 12/1972 | Murphey, Jr. | 175/320 |
| 3,888,319 | 6/1975 | Bourne et al. | 175/76 |
| 4,042,046 | 8/1977 | Capoccia | 175/45 X |
| 4,241,796 | 12/1980 | Green et al. | 175/24 |
| 4,394,881 | 7/1983 | Shirley | 175/76 |
| 4,407,374 | 10/1983 | Wallussek et al. | 175/24 |
| 4,438,820 | 3/1984 | Gibson | 175/45 |
| 4,466,496 | 8/1984 | Jones | 175/321 X |
| 4,592,432 | 6/1986 | Williams et al. | 175/26 |
| 4,705,119 | 11/1987 | Kostylev et al. | 175/92 |
| 4,834,193 | 5/1989 | Leitko, Jr. et al. | 175/26 X |
| 4,854,397 | 8/1989 | Warren et al. | 175/27 X |
| 4,958,689 | 9/1990 | Lee | 175/71 X |

*Primary Examiner*—William P. Neuder
*Attorney, Agent, or Firm*—Trask, Britt & Rossa

[57] ABSTRACT

The present invention discloses a drilling tool apparatus and method for sinking drill holes in underground rock formations while using a selectable direction profile for the drill hole.

12 Claims, 2 Drawing Sheets

DIRECTIONAL DRILLING TOOL APPARATUS AND METHOD

BACKGROUND OF THE INVENTION

The present invention is based on the problem of creating a directional drilling tool that improves directional drilling behavior and increases drilling progress.

BRIEF DESCRIPTION OF THE INVENTION

The design disclosed herein of a drilling tool with an impact device acting on its bit shaft allows for a drilling operation with a much reduced static compressive force on the drill bit which results in correspondingly reduced lateral force components on the drill bit which, in an ordinary design, act as interference forces on the desired directional behavior of the drilling tool. The smaller deflections of the drilling tool due to the reduced lateral forces are compensatable with lower radial control forces and the reduction in deviations combined with the reductions in the control forces increase the efficiency of the rock destruction process at the drill bit and allow for considerable increases in the rate of drilling progress. The drilling tool disclosed herein can be used with particularly favorable results in hard or brittle rock and in soil conditions with layers unfavorable to direction control.

DETAILED DESCRIPTION OF THE INVENTION

Figure 1:
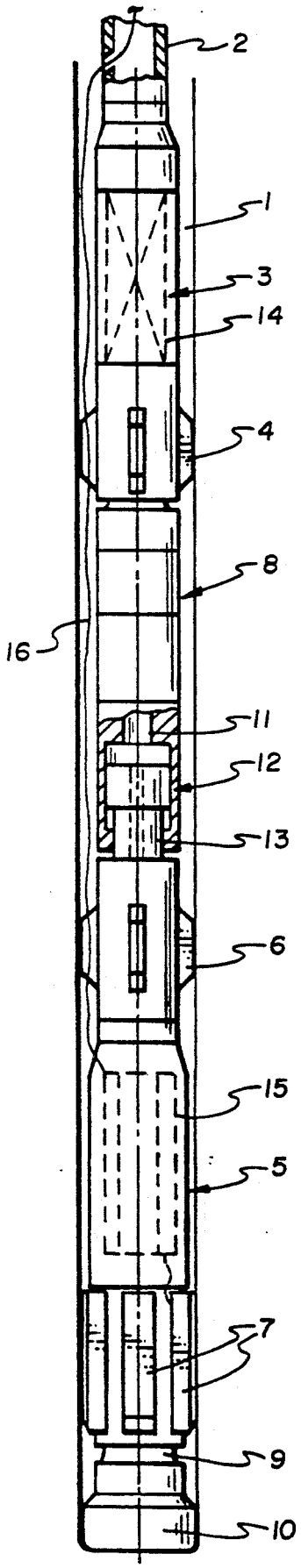
FIG. 1 shows one embodiment of the present invention in a cut-away, partially broken off side view.

The drilling tool disclosed herein and illustrated schematically in FIG. 1 is shown in drill hole 1 and is connectable at its upper end via connectors, e.g., screw threads (not shown), to a drill string 2 and comprises a torsion resistant tool housing having an upper housing unit 3 that is provided at its lower region with stabilizer fins 4 and a lower housing unit 5 whose upper region is provided with stabilizer fins 6 and whose lower region is provided with four energizers 7 designed as lateral pressure elements capable of moving radially inwardly and outwardly. When in contact with the wall of the drill hole 1, energizers 7 determine the alignment of the drilling tool and thus the heading of the drill bit 10 and the eventual drill hole.

The drilling tool also comprises a bit shaft 8, rotatably mounted in the upper housing unit 3, rotatably extending through the lower housing unit 5, and bearing a drill bit 10 on its lower end 9 protruding from the lower housing unit 5. The bit shaft 8 is designed as a hollow shaft which surrounds a central, longitudinal channel 11 that forms a continuation of the interior of the drill string 2 and that ends at an opening in the region of the drill bit 10. An impact device or hammer assembly 12 is included as a component of the bit shaft 8 between the upper and lower housing unit 3 and 5, respectively.

The impact device or hammer assembly 12 can have any known or suitable design driven by means of the drilling fluid to generate axial vibrational forces in the lower unit 13 of the bit shaft 8 that are superimposed on a small static axial force and impart a pressure component of a threshold characteristic upon the drill bit 10. The upper end of the bit shaft 8 is linked with a rotary drive 14 located in the upper housing unit 3 and indicated schematically in FIG. 1. The drive 14 sets the drill bit shaft 8 into a preferably slow rotation which in turn gives the drill bit 10 a rotational motion.

The lower housing unit 5, which is of a tubular design like the upper housing unit 3, includes a control device 15, schematically illustrated in FIG. 1, which includes sensors used to determine the drill hole parameters, i.e., the particular position of the boring tool and especially its inclination, a processing means to evaluate the acquired data, and a transducer unit to issue control commands to the pressure operated energizers 7, of which there are at least four distributed along the perimeter of the lower housing unit 5 positioned radially in predetermined positions. The sensing, evaluating, and transducer units are not specifically shown in FIG. 1 but are generally indicated by control device 15 and can consist of various such units well known in the drilling art.

Figure 2:
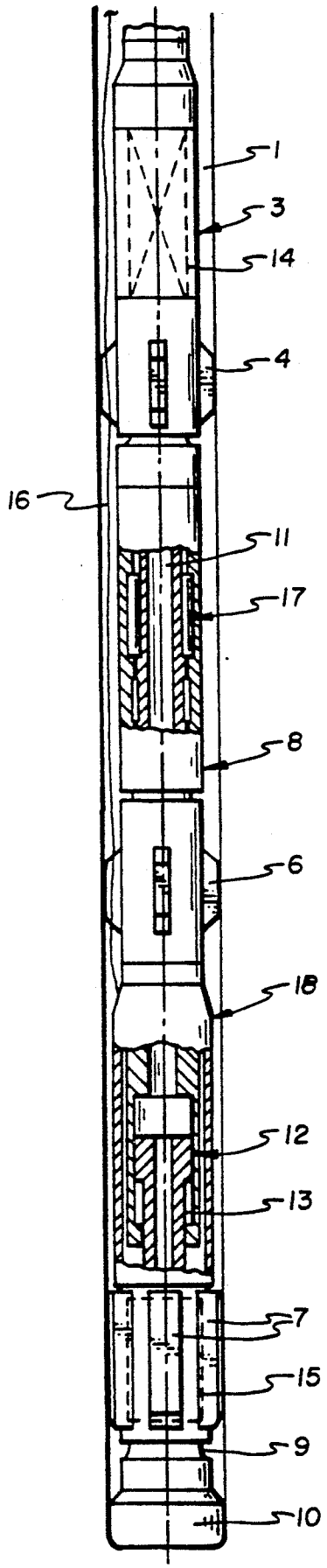
FIG. 2 shows another embodiment of the present invention in a cut-away, partially broken off side view.

The sensing, evaluating, and transducer units of the control device 15 can control the directional profile of the drill hole 1 according to a specified program and can be equipped with a separate power source (not shown). Nevertheless, they can also be linked to an above-ground controller (not shown) via a connector cable 16 for a continual data exchange as shown in FIGS. 1 and 2. A power supply to the control device 15 can be provided via the connector cable 16 which should generally run inside the drill string 2 and then, for at least a part of its length, in the annulus of the hole 1 drilled by the drilling tool.

Compressed air is preferred as the drilling fluid or agent for the drilling tool disclosed herein, especially for drilling in mining or in construction where, frequently, depths of only a few hundred meters are needed. Use of compressed air as the drilling fluid also improves removal of fines in hard formations. Furthermore, when compressed air is used as the drilling fluid, other electrical transmission elements can be used, e.g., slip ring transferors or transformational couplings (not shown) in place of the connector cable 16. When a liquid drilling fluid is used, however, information is obtained from sequential pressure changes in the drilling fluid column, as is common in deep drilling. The design of the overall system operated by the drilling fluid, such as the specific rotary drive and impact device, is generally tailored to the particular drilling fluid used.

FIG. 2 illustrates a design of the invention disclosed herein where a shock absorber 17 acts upon the bit shaft 8 above the impact device 12. This shock absorber 17 is a component of the bit shaft 8 and is located in the region between the housing units 3 and 5, where the impact device 12 is located in FIG. 1. The impact device 12 of FIG. 2 is located in the region of the bit shaft 8, where the housing unit 5 is located in FIG. 1.

Accordingly, in the embodiment shown in FIG. 2, the control device 15 is located in the lower region of the housing unit 18 and at the level of the energizers 7. This control device 15 is also linked to an above ground control unit via a connector cable 16. The shock absorber 17 braces the threaded connectors under occurring axial shock stresses so that the amplitude of the axial force vibrations can be readily increased without effecting the threaded connections (not shown) or the components of the measuring and evaluation units of the control device 15. This, in turn, allows for an increase in the drilling rate.

In the foregoing specifications, this invention has been described with reference to specific exemplary embodiments thereof. It will, however, be evident that various modifications and changes may be made thereunto without departing from the broader spirit and scope of the invention as set forth in the appended claims. The specification and drawings included herein are, accordingly, to be regarded in an illustrative rather than in a restrictive sense.

What is claimed is:

1. A drilling tool for directionally drilling in underground rock formations, comprising:

an upper housing unit including a rotary drive unit and having means thereon for securing said tool to a drill string;

a lower housing unit;

a bit shaft including a fluid-driven impact device extending from said rotary drive unit through said lower housing unit to a drill bit;

at least four energizers disposed about the periphery of said lower housing unit and adapted to impart lateral directional forces to said drilling tool; and control means adapted to selectively control said energizers.

2. The apparatus of claim 1, wherein said control means includes sensors for ascertaining the path of the hole being drilled by said drilling tool.

3. The apparatus of claim 2, wherein said control means is self-contained within said drilling tool.

4. The apparatus of claim 1, further including a shock absorber associated with the bit shaft above said impact device.

5. The apparatus of claim 1, wherein said drilling fluid is compressed air.

6. The apparatus of claim 4, wherein said drilling fluid is compressed air.

7. The apparatus of claim 1, wherein said control means is connected via a connector cab le to an above ground controller.

8. The apparatus of claim 4, wherein said control means is connected via a connector cable to an above ground controller.

9. The apparatus of claim 7, wherein said connector cable runs partially inside said drill string and partially in the annulus of a bore hole drilled by said drilling tool.

10. The apparatus of claim 8, wherein said connector cable runs partially inside said drill string and partially in the annulus of a bore hole drilled by said drilling tool.

11. A method of sinking drill holes in underground rock formations using a drilling tool including a drilling shaft and drill bit pursuant to a selectable directional profile for the drill hole comprising the steps of:

selecting the directional profile for said directional drill hole;

rotating said drilling shaft and drill bit;

generating axial vibrational forces by an impact device acting on said drilling shaft and drill bit;

determining the position of the drilling tool;

evaluating said determined drilling tool position as compared to said selected drill hole profile;

orienting said drilling tool in conjunction with said drill hole profile evaluation to follow said selected directional profile; and repeating said determining, evaluating, and orienting steps in order to drill said hole to said selected drill hole profile.

12. The method of claim 11, wherein said generated axial vibrational forces are absorbed by a shock absorber acting on said drilling shaft above said impact device.

* * * * *